US009889680B2

(12) United States Patent
Ohshima

(10) Patent No.: US 9,889,680 B2
(45) Date of Patent: Feb. 13, 2018

(54) LIQUID DISCHARGE APPARATUS, METHOD OF APPLYING TREATMENT LIQUID TO MEDIUM, AND IMAGE FORMING METHOD

(71) Applicant: Tohru Ohshima, Kanagawa (JP)

(72) Inventor: Tohru Ohshima, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/366,210

(22) Filed: Dec. 1, 2016

(65) Prior Publication Data

US 2017/0173972 A1 Jun. 22, 2017

(30) Foreign Application Priority Data

Dec. 17, 2015 (JP) ..... 2015-246152
Oct. 27, 2016 (JP) ..... 2016-211031

(51) Int. Cl.

*B41J 2/01* (2006.01)
*B41J 11/00* (2006.01)
*B41M 5/00* (2006.01)
*B41J 15/04* (2006.01)

(52) U.S. Cl.

CPC ..... *B41J 11/002* (2013.01); *B41J 11/0015* (2013.01); *B41M 5/0011* (2013.01); *B41J 15/04* (2013.01)

(58) Field of Classification Search

None

See application file for complete search history.

(56) References Cited

U.S. PATENT DOCUMENTS

2009/0171007 A1* 7/2009 Jonai ..... C09D 11/101 524/548
2010/0234200 A1* 9/2010 Kurisu ..... C21D 9/56 492/53
2013/0076814 A1* 3/2013 Kanaya ..... B41J 3/4078 347/9
2013/0293617 A1 11/2013 Suzuki et al.
2014/0043393 A1 2/2014 Takeuchi
2014/0253631 A1 9/2014 Namba et al.

(Continued)

FOREIGN PATENT DOCUMENTS

JP 5-025417 2/1993
JP 2005-007700 1/2005
JP 2008-162265 7/2008

(Continued)

OTHER PUBLICATIONS

European search report dated Jun. 20, 2017 in connection with corresponding European patent application No. 16201247.0.

*Primary Examiner* — Erica Lin
(74) *Attorney, Agent, or Firm* — Cooper & Dunham, LLP

(57) ABSTRACT

A liquid discharge apparatus includes a device to apply a treatment liquid to a medium; a drying device to dry the treatment liquid applied to the medium; a device to apply a liquid containing a colorant to the medium on which the treatment liquid has been applied; and a control device. The control device controls a supply amount of the treatment liquid to an amount such that a surface hardness of the medium is 0.07 GPa or more as measured by nano indentation after the drying device dries a surface of the medium.

12 Claims, 9 Drawing Sheets

(56) References Cited

U.S. PATENT DOCUMENTS

2015/0022582 A1 1/2015 Katsuragi

FOREIGN PATENT DOCUMENTS

| | | |
|---|---|---|
| JP | 2009-256852 | 11/2009 |
| JP | 2010-052284 | 3/2010 |
| JP | 2014-034167 | 2/2014 |
| JP | 2015-074110 | 4/2015 |

* cited by examiner

LIQUID DISCHARGE APPARATUS, METHOD OF APPLYING TREATMENT LIQUID TO MEDIUM, AND IMAGE FORMING METHOD

CROSS-REFERENCE TO RELATED APPLICATIONS

The present application claims priority pursuant to 35 U.S.C. § 119(a) from Japanese patent application numbers 2015-246152, filed on Dec. 17, 2015, and 2016-211031, filed on Oct. 27, 2016, the entire disclosure of each of which is incorporated by reference herein.

BACKGROUND

Technical Field

Exemplary embodiments of the present disclosure relate to a liquid discharge apparatus, method of applying a treatment liquid to a medium, and image forming method.

Background Art

In a device to discharge a liquid onto a continuous medium, there are strict requirements for the physical properties of a useable liquid to ensure long-term stable discharge. Not only the medium that is subjected to a non-permeable surface property improvement treatment, but also the permeable medium needs to be used. Herein, continuous media include rolled paper, continuous sheet, ledger sheet, and web media.

A certain medium employing a high-speed drying type of ink is disclosed, in which a solvent is evaporated at high speed and dehumidified. Another approach is disclosed in which a pre-treatment liquid or primer is applied to the medium so that the quality of the surface of the medium is improved, and then printing is performed to prevent reduction of reliability in the discharge after a long period of operation.

SUMMARY

In one embodiment of the disclosure, provided is an optimal liquid discharge apparatus including a device to apply a treatment liquid to a medium; a drying device to dry the treatment liquid applied to the medium; a device to apply a liquid containing a colorant to the medium on which the treatment liquid has been applied; and a control device. The control device controls a supply amount of the treatment liquid to an amount such that a surface hardness of the medium is 0.07 GPa or more as measured by nano indentation after the drying device dries a surface of the medium.

Further, provided is an optimal method of applying a treatment liquid to a medium to which a liquid including a colorant is applied. The method includes, before the liquid including the colorant is applied, applying the treatment liquid in an amount such that a surface hardness of the medium is 0.07 Gpa or more as measured by nano indentation after the treatment liquid is dried.

Furthermore, provided is an optimal method of forming an image including applying a treatment liquid to a medium; drying the treatment liquid; and applying a liquid including a colorant to the medium to thereby form an image. In the method, the liquid including the colorant is applied to the medium with a surface hardness of 0.07 GPa or more as measured by nano indentation after the treatment liquid is dried.

These and other features and advantages of the present disclosure will become apparent upon consideration of the following description of embodiments when taken in conjunction with the accompanying drawings.

BRIEF DESCRIPTION OF THE DRAWINGS

The aforementioned and other aspects, features, and advantages of the present disclosure would be better understood by reference to the following detailed description when considered in connection with the accompanying drawings, wherein.

DETAILED DESCRIPTION

Hereinafter, embodiments of the present disclosure is described with reference to accompanying drawings.

Figure 1:
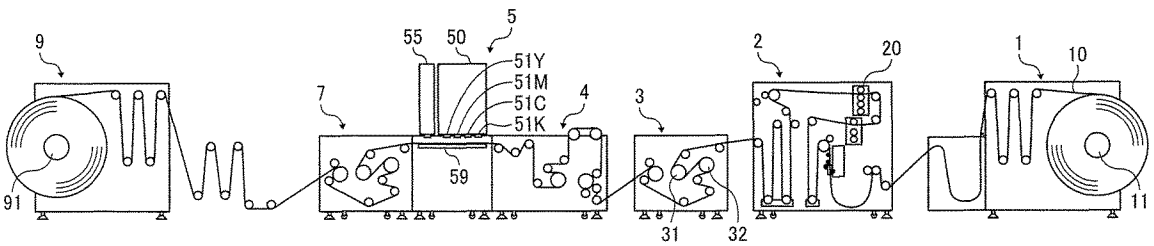
FIG. 1 illustrates a liquid discharge apparatus as an embodiment of the present disclosure.

FIG. 1 illustrates a liquid discharge apparatus 100 according to an embodiment of the present disclosure. The liquid discharge apparatus 100 includes a carry-in device 1 to carry in a continuous medium (hereinafter, simply a medium) 10; a pre-treatment device 2 to apply a pre-treatment liquid to the medium 10 carried in from the carry-in device 1; and a drying device (or a first drying device) 3 after pre-treatment liquid application to dry the pre-treatment liquid applied to the medium 10.

The liquid discharge apparatus 100 further includes a guiding device 4 and a printing device 5. The guiding device 4 guides and conveys the medium 10 that has passed through the first drying device 3, to the printing device 5 that performs printing to discharge a liquid containing a colorant to the medium 10 and form an image. The liquid discharge apparatus 100 further includes a drying device 7 (or a second drying device 7) to dry the medium 10 after image formation, and a carry-out device 9 to carry out the medium 10.

The medium 10 includes a substrate and a surface property improvement process layer including at least an aqueous resin filmed on the substrate.

The medium 10 is sent out from an original roller 11 of the carry-in device 1, is guided by each roller of the carry-in device 1, the pre-treatment device 2, the first drying device 3, the guiding device 4, the second drying device 7, and the carry-out device 9, and is rolled up by a wind-up roller 91 in the carry-out device 9.

The pre-treatment device 2 includes a pre-treatment liquid applicator 20 that applies a coat of a pre-treatment liquid to the medium 10, the coated pre-treatment liquid is dried by the first drying device 3, and the medium 10 reaches the printing device 5. The printing device 5 includes a conveyance guide 59, a liquid discharge unit 50, and a post-treatment liquid discharge unit 55. The medium 10 is conveyed on the conveyance guide 59 and opposite the liquid discharge unit 50 and the post-treatment liquid discharge unit 55.

The liquid discharge unit 50 discharges a liquid onto the medium 10, thereby forming a predetermined image on the medium 10. If appropriate, the post-treatment liquid discharge unit 55 discharges a post-treatment liquid for post-treatment to the medium 10.

Herein, the liquid discharge unit 50 includes four-color full-line type head units 51K, 51C, 51M, and 51Y disposed in this order from upstream in the medium conveyance direction. The heat units 51K, 51C, 51M, and 51Y may be referred to as the head unit 51, if each color not discriminate.

Each head unit 51 discharges a liquid including a colorant. The heat units 51K, 51C, 51M, and 51Y discharge liquids of black (K), cyan (C), magenta (M), and yellow (Y), respectively, to the conveyed medium 10. The type and number of colors are not limited to the above examples.

Figure 2:
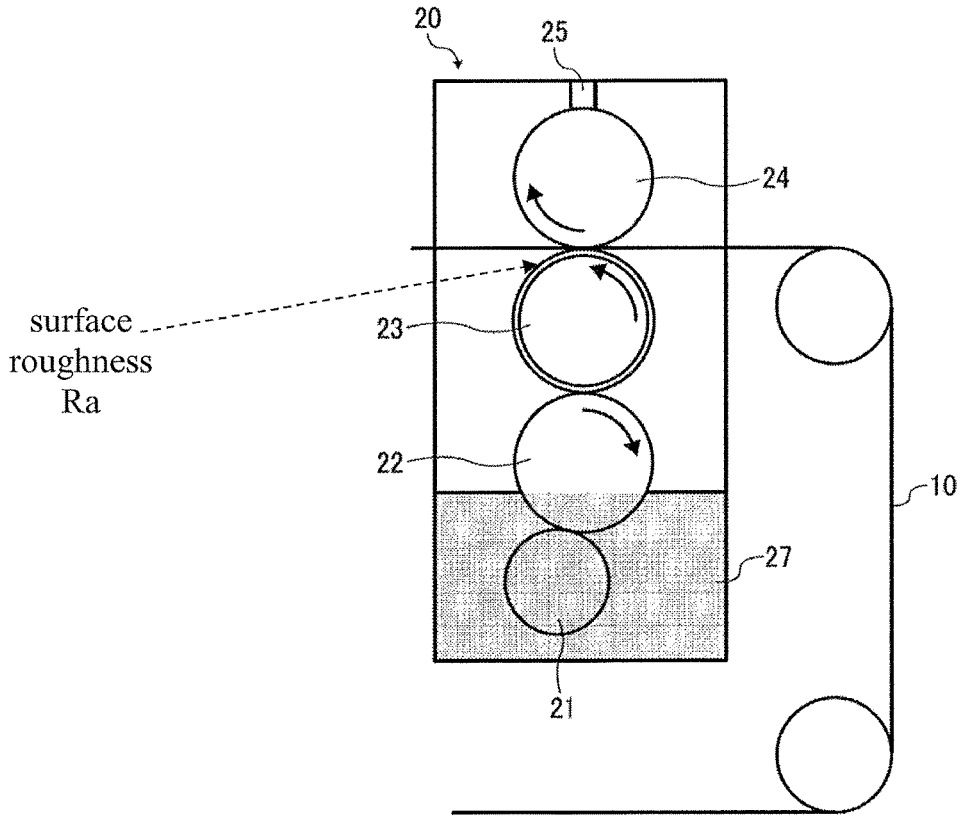
FIG. 2 illustrates a pre-treatment device.

Referring to FIG. 2, the pre-treatment device 2 is described.

The pre-treatment liquid applicator 20 of the pre-treatment device 2 applies a reserved pre-treatment liquid 27 onto a surface of the medium 10 that has been carried into the pre-treatment device 2 by the carry-in device 1.

More specifically, the pre-treatment liquid applicator 20 first causes a stirring roller 21 and a thin-film forming roller 22 to transfer the pre-treatment liquid 27 onto a surface of a coating roller 23 filmily.

Next, the pre-treatment liquid applicator 20 pushes the coating roller 23 against the platen roller 24 that rotates the coating roller 23, and the coating roller 23 rotates. At this time, the medium 10 is conveyed in a gap between the coating roller 23 and the platen roller 24, so that the pre-treatment liquid 27 is coated on the surface of the medium 10.

In addition, the pre-treatment liquid applicator 20 causes a pressure adjuster 25 to adjust a nip pressure when the pre-treatment liquid 27 is applied to the medium 10. The term "nip pressure" means a pressure applied at a position where the coating roller 23 and the platen roller 24 meet.

With this structure, the pre-treatment liquid applicator 20 causes the pressure adjuster 25 to vary the nip pressure, so that a supply amount (such as a coated amount, film thickness, liquid amount, adhesion amount, and drying and adhesion amount) of the pre-treatment liquid 27 can be optimally controlled.

Further, by changing a rotary speed of the coating roller 23 and the platen roller 24, the supply amount of the pre-treatment liquid 27 can be controlled.

Next, an example of the pre-treatment liquid will be described.

The pre-treatment liquid contains a substance to agglomerate water-dispersible pigment particles; a water-soluble organic solvent; a permeable agent; a surfactant; water; and other substances as appropriate.

Examples of substances to agglomerate water-dispersible pigment particles include water-soluble aliphatic organic acids. Herein, agglomeration means that the water-dispersible pigment particles are stuck to each other, and the degree of agglomeration can be ascertained by particle size distribution measurement equipment.

When an ion substance such as a water-soluble aliphatic organic acid is added to the pre-treatment liquid, ions are stuck to surface electrical charge of the water-dispersible pigment and the surface electrical charge is neutralized, so that the agglomeration effect is strengthened due to the intermolecular force and the pigment can be agglomerated.

A method to check if the agglomeration has occurred includes a method to check whether the pigment is agglomerated instantaneously when 5 μL of inkjet ink including the water-dispersible pigment of a density of 5 mass % is added to 30 mL of the pre-treatment liquid.

Examples of water-soluble organic solvent are not particularly limited and can be selected appropriately according to the purpose. For example, included are multivalent alcohols such as ethylene glycol, diethylene glycol, triethylene glycol, tetraethylene glycol, polyethylene glycol, propylene glycol, 1,3-butanediol, 1,3-propanediol, 2-methyl-1,3-propanediol, 1,4-butanediol, 1,5-pentanediol, 1,6-hexanediol, glycerin, 1,2,6-hexane triol, 2-ethyl-1,3-hexanediol, 1,2,4-butanetriol, 1,2,3-butanetriol, and petriol or 3-Methyl-1,3,5-pentanetriol; multivalent alcohol alkyl ethers such as ethylene glycol monoethyl ether, ethylene glycol monobutyl ether, diethylene glycol monomethyl ether, diethylene glycol monoethyl ether, diethylene glycol monobutyl ether, triethylene glycol monobutyl ether, tetraethylene glycol monomethyl ether, and propylene glycol monoethyl ether; multivalent alcohol allyl ethers such as ethylene glycol monophenyl ether, and ethylene glycol monobenzyl ether; nitrogen-containing heterocyclic compounds such as N-methyl-2-pyrrolidone, N-hydroxyethyl-2-pyrrolidone, 2-pyrrolidone, 1,3-dimethyl imidazolidinone, and ϵ-caprolactam; amides such as formamide, N-methyl formamide, N,N-dimethyl formamide; amines such as monoethanol amine, diethanol amine, triethanol amine, monoethyl amine, diethylamine, trimethylamine; sulfur-containing compounds such as dimethyl sulfoxide, sulfolane, and thiodiethanol; and propylene carbonate, carbonic acid ethylene, and γ-butyrolactone. These water-soluble organic solvents may be used singularly but two or more solvents may be used in combination.

A content ratio of the water-soluble organic solvent is preferably from 5 to 80 mass % and more preferably from 10 to 20 mass % relative to a whole content of the pre-treatment liquid.

Examples of the permeable agent are not particularly limited and can be selected appropriately according to the purpose. For example, included are alkyl and allyl ethers of multivalent alcohol such as diethylene glycol monophenyl ether, ethylene glycol monophenyl ether, ethylene glycol monoallyl ether, diethylene glycol monophenyl ether, diethylene glycol monobutyl ether, propylene glycol monobutyl ether, and tetraethylene glycol chlorophenyl ether; and lower alcohols such as ethanol, and 2-propanol. These permeable agents may be used singularly but two or more agents may be used in combination.

A content ratio of the permeable agent is preferably from 0.1 to 20 mass % and more preferably from 0.5 to 10 mass % relative to a whole content of the pre-treatment liquid.

Examples of surfactant include anion surfactant, nonionic surfactant, cationic surfactant, ampholytic surfactant, fluoric surfactant, and silicon surfactant.

A content ratio of the surfactant is preferably from 0.01 to 3.0 mass % and more preferably from 0.5 to 2 mass % relative to a whole content of the pre-treatment liquid. When the content ratio is below 0.01 mass %, effects of addition of the surfactant may not be obtained. When the content exceeds 3.0 mass %, permeability of the pigment to the medium increases beyond necessity, which may result in lowering of the formed image density and occurrence of a bleed-through.

Other substances are not particularly limited and may be selected appropriately depending on the purpose. For example, any antiseptic and mildew-proofing agent, anticorrosive agent, and pH adjuster may be used.

Examples of the antiseptic and mildew-proofing agent include, for example, sodium dehydroacetate, sodium sorbate, sodium-2-pyridinethiol-1-oxide, isothiazoline-system compound, sodium benzoate, and sodium pentachlorophenol.

A content ratio of the antiseptic and mildew-proofing agent is preferably from 0.01 to 3.0 mass % and more preferably from 0.5 to 2 mass % relative to a whole content of the pre-treatment liquid.

Examples of the anticorrosive agent include, for example, benzotriazole, acid sulphite, sodium thiosulphate, thiodiglycolate ammonium, diisopropyl ammonium nitrite, pentaerythritol tetranitrate, and dicyclohexyl ammonium nitrite.

A content ratio of the anticorrosive agent is preferably from 0.01 to 3.0 mass % and more preferably from 0.5 to 2 mass % relative to a whole content of the pre-treatment liquid.

Examples of the pH adjuster include, for example, hydroxides of alkali metal elements such as lithium hydroxide, sodium hydroxide, and potassium hydrate; carbonates of alkali metals such as ammonium hydroxide, quaternary ammonium hydroxide, quaternary phosphonium hydroxide, lithium carbonate, sodium carbonate, and potassium carbonate; amines such as diethanolamine, and triethanolamine; and boric acid, hydrochloric acid, nitric acid, sulphuric acid, and acetic acid.

A content ratio of the pH adjuster is preferably from 0.01 to 3.0 mass % and more preferably from 0.5 to 2 mass % relative to a whole content of the pre-treatment liquid.

Next, referring again to FIG. 1, the first drying device 3 after pre-treatment liquid application will be described.

The first drying device 3 includes heat rollers 31 and 32. The medium 10 on which the pre-treatment liquid 27 is coated, is conveyed by the feed rollers to the heat rollers 31 and 32. The heat rollers 31 and 32 are heated at a high temperature of from 50° C. to 100° C., moisture is evaporated from the medium 10 to which the pre-treatment liquid 27 is applied, due to the heat by contacting the heat roller 31 and 32, and the medium 10 is dried.

Figure 3:
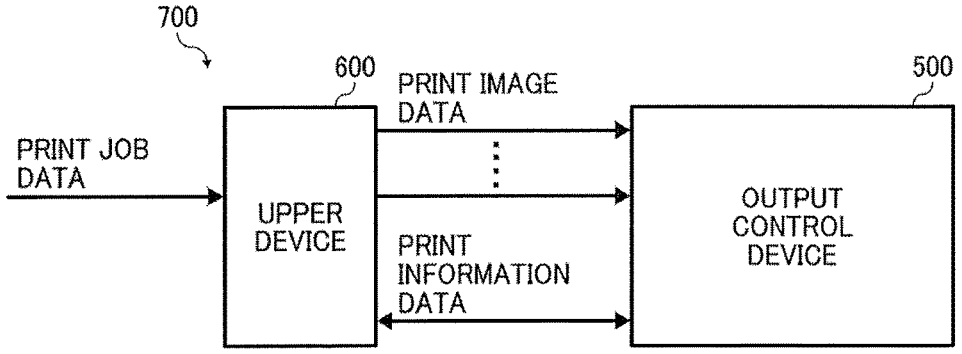
FIG. 3 is a block diagram of a control device.
Figure 4:
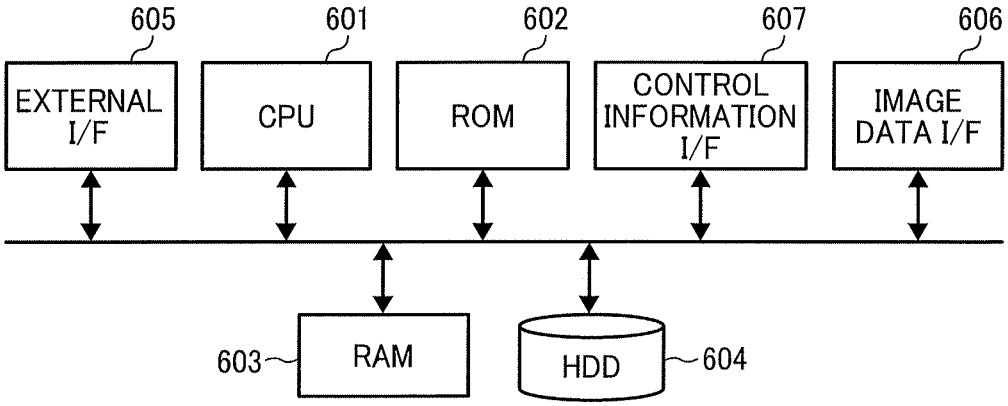
FIG. 4 is a block diagram of an upper device that forms the control device.
Figure 5:
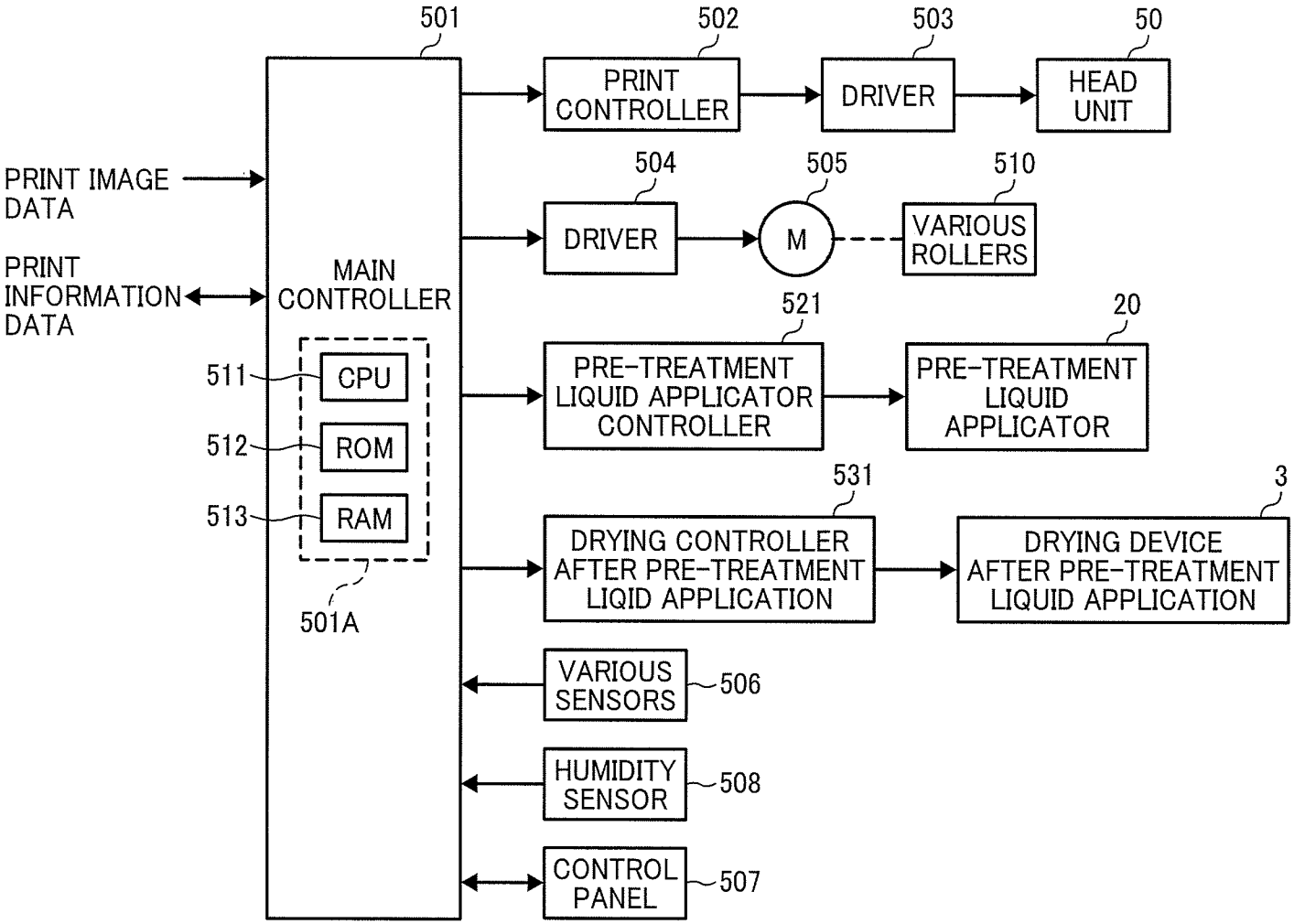
FIG. 5 is a block diagram of an output control device that forms the control device.

Next, referring to FIGS. 3 to 5, a control device 700 of the liquid discharge apparatus 100 is described.

FIG. 3 is a block diagram of the control device 700; FIG. 4 is a block diagram of an upper device 600 that forms the control device; and FIG. 5 is a block diagram of an output control device 500 that forms the control device 700.

The control device 700 includes the upper device 600 that receives and processes print job data from a host device and transfers the processed data to the output control device 500, and the output control device 500 that receives print image data from the upper device 600 and processes data related to printing.

The upper device 600 performs Raster Image Processor (RIP) processing that requires time for processing. The output control device 500 performs printing processes.

The upper device 600 performs RIP processing based on the print job data output from the host device. More specifically, based on the print job data, the upper device 600 generates print image data being bitmap data corresponding to each color.

The upper device 600 generates control information data being data to control printing operation based on the print job data and the host device information. Here, the control information data includes various data related to printing conditions such as print form, print type, paper supply data, printing order, printing paper size, data size of the printing image data, resolution, paper type information, gradation, color information, and number of pages for printing.

As illustrated in FIG. 4, the upper device 600 includes a central processing unit (CPU) 601, a read-only memory (ROM) 602, a random access memory (RAM) 603, a hard disk drive (HDD) 604, an external interface (I/F) 605, an image data I/F 606, and a control information I/F 607.

The upper device 600 receives print job data from the host device via the external I/F 605, generates bitmap data for YMCK, writes generated bitmap data for each color to the RAM 603, compacts and encodes the bitmap data for each color, and temporarily stores the encoded data into the HDD 604.

Thereafter, when printing operation starts, the upper device 600 decodes the bitmap data for each color and writes the decoded data into the RAM 603 temporarily, reads the bitmap data for each color and transfers the bitmap data for each color as the print image data for each color, to the output control device 500 via the image data I/F 606.

In addition, the upper device 600 sends and receives the control information data to and from the output control device 500 via the control information I/F 607, in accordance with the proceeding of the printing operation.

As illustrated in FIG. 5, the output control device 500 includes a microcomputer 501A that includes a CPU 511 to control operation of the whole liquid discharge apparatus, a ROM 512, a RAM 513, and input-outputs (I/Os); and a main controller (or a system controller) 501 including image memories and communication interfaces.

The main controller 501 sends print image data to a print controller 502 so as to form an image on the medium 10 based on the print image data and the print information data transferred from the upper device 600.

The print controller 502 receives the print image data from the main controller 501 and transfers the print image data as serial data, and outputs transfer clocks and latch signals and control signals necessary for transferring and verifying the transfer of the printing data, to a head driver 503.

Further, the print controller 502 includes a drive waveform generator that is formed of a D/A converter to digital-to-analog convert pattern data of common drive waveforms stored in the internal ROM, a voltage amplifier, and a current amplifier, and outputs drive waveforms formed of a single or a plurality of drive pulses, to the head driver 503.

The head driver 503 selects a drive pulse forming the drive waveform given from the print controller 502 based on the print image data corresponding to a serially-input head unit 51, and transfer the drive pulse to a pressure generator to thereby let the liquid to be discharged. In this case, the head driver 503 selects a part or all of the pulse forming the drive waveform, or all or a part of the waveform elements forming the pulse, so that various dots different in size such as a large dot, medium dot, and small dot can be injected.

The main controller 501 controls, via a motor driver 504, driving of various motors 505 that drive each roller of the original roller 11 of the carry-in device 1, the carry-in device 1, the pre-treatment device 2, the first drying device 3 after pre-treatment liquid application, the guiding device 4, the second drying device 7, and the carry-out device 9, and various rollers 510 such as the wind-up roller 91 of the carry-out device 9. It is noted that all rollers need not be given a driving force.

The main controller 501 gives information on the supply amount or coating amount of the pre-treatment liquid 27, to the pre-treatment liquid applicator controller 521. The pre-treatment liquid applicator controller 521 causes the pressure adjuster 25 of the pre-treatment liquid applicator 20 to vary the pressure so that the pre-treatment liquid 27 is applied with the supply amount received from the main controller 501.

The main controller 501 gives a drying controller 531 after pre-treatment liquid application, information on a drying temperature of the medium 10 to which the pre-treatment liquid 27 is applied. The drying controller 531 controls the temperature of the heat rollers 31 and 32 of the first drying device 3 after pre-treatment liquid application, to be identical to the received drying temperature of the medium 10.

The main controller 501 inputs detected signals from a humidity sensor 508 to detect an environmental humidity and from various sensors 506 including other various sensors, and performs input and output of the various information to and from a control panel 507 and handles displayed information.

Next, factors causing a so-called piling phenomenon will be described.

When the pre-treatment liquid as a surface property improvement process liquid is further applied to a medium that has already been subjected to a coating, foreign substances having viscosity may be gradually accumulated due to inconsistence between the original coating material and the pre-treatment liquid, which is called piling.

When the piling phenomenon occurs and the foreign substances are displaced from a contacting member onto the medium, print quality degrades.

Handling of the piling phenomenon is very difficult, because occurrence factors and control factors have not been recognized yet, and the time period from the start of the operation to the occurrence of piling varies greatly, due to the type of medium and operation state of the device, in a running distance of the medium from several tens of kilometers to a hundred and several tens of kilometers.

Foreign substances piled in the liquid discharge apparatus were analyzed by infrared spectroscopy, and it turned out that the piled foreign substances were formed of the content of the coat layer of the coated paper used. In addition, it was found that the starch component used as a binder in the coat layer of the coated paper is plasticized by the solvent of the pre-treatment liquid and is deposited to the feed member with viscosity.

According to these factors, it is found that the piling phenomenon occurring when the pre-treatment liquid is applied to the coated medium subjected to the surface property improvement process occurs as follows. The binder resin in the outstanding coat layer (or the surface property process layer), and, in particular, water-soluble resins such as the starch and polyvinyl alcohol are softened due to aqueous ingredients in the pre-treatment liquid and water-soluble solvent, abraded with pigments on the surface of the medium, and piled on the contact member.

However, computation of the degree of abrasion of the outstanding surface property improvement process layer from a total amount of the piling substance occurring in the actual liquid discharge apparatus results in abrasion and piling amount of several tens to several hundreds angstrom in the surface layer. This degree of abrasion amount is very negligible and it is very difficult to quantize and forecast the abrasion state by analyzing the outstanding surface property process layer itself.

Next, control of the supply amount of the pre-treatment liquid according to the present embodiment will be described.

In the present embodiment, the supply amount of the pre-treatment liquid 27 to be applied to the medium 10 is set to an amount that a surface hardness, as measured by the nano-indentation method, of the medium 10 after the pre-treatment liquid 27 has been dried is 0.07 GPa or more.

In this case, it is preferred that the elasticity of the medium 10, by the nano-indentation method, after the pre-treatment liquid 27 has been dried, become 4 GPa or more.

Further, it is preferred that the surface harness and the elasticity of the medium 10 be measured at a depth of 500 nm from the topmost surface layer of the medium 10.

The surface harness of the medium 10 is measured and obtained by Nano-indentation method. The measurement may be performed by using, for example, a nano-indenter (Trade name T1950 Tribo Indenter produced by Hysitron, Inc.).

Figure 6:
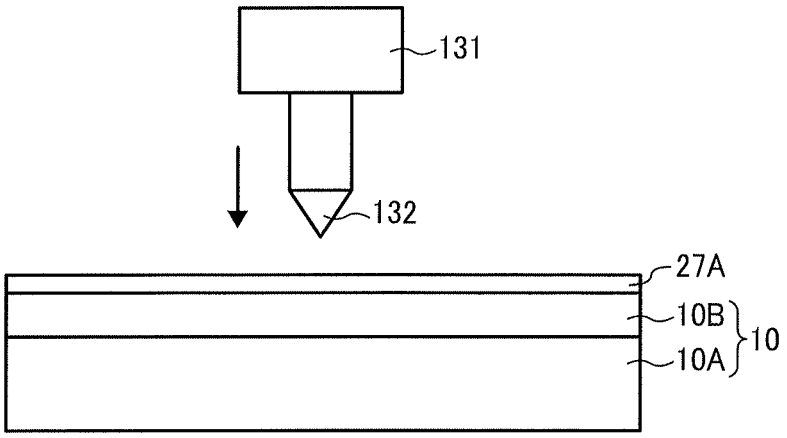
FIG. 6 illustrates a method for measuring hardness using nano-indentation.

Referring to FIG. 6, measurement of the hardness and elasticity by the nano-indentation method is described below.

The measurement of the hardness by the nano-indentation method is performed such that a relation between a load and push-in depth (displacement amount) is measured while pushing the minute diamond indenter into the thin layer, and plastic deformation hardness is calculated based on the obtained measurement value.

More specifically, as illustrated in FIG. 6, the medium 10 includes a substrate 10A and a coat layer 10B filmed on the surface of the substrate 10A. The coat layer 10B includes at least water-soluble resins and serves as a surface property improvement process layer. The pre-treatment liquid 27 is applied to the medium 10 and is dried, so that a pre-treatment liquid layer 27A is filmed on the coat layer 10B.

Then, using a transducer 131 and a diamond Berkovich indenter 132 having an equilateral-triangular tip shape while applying a load of μN order, a displacement amount of the topmost surface of the medium 10 is measured at a precision of nanometer.

Figure 7:
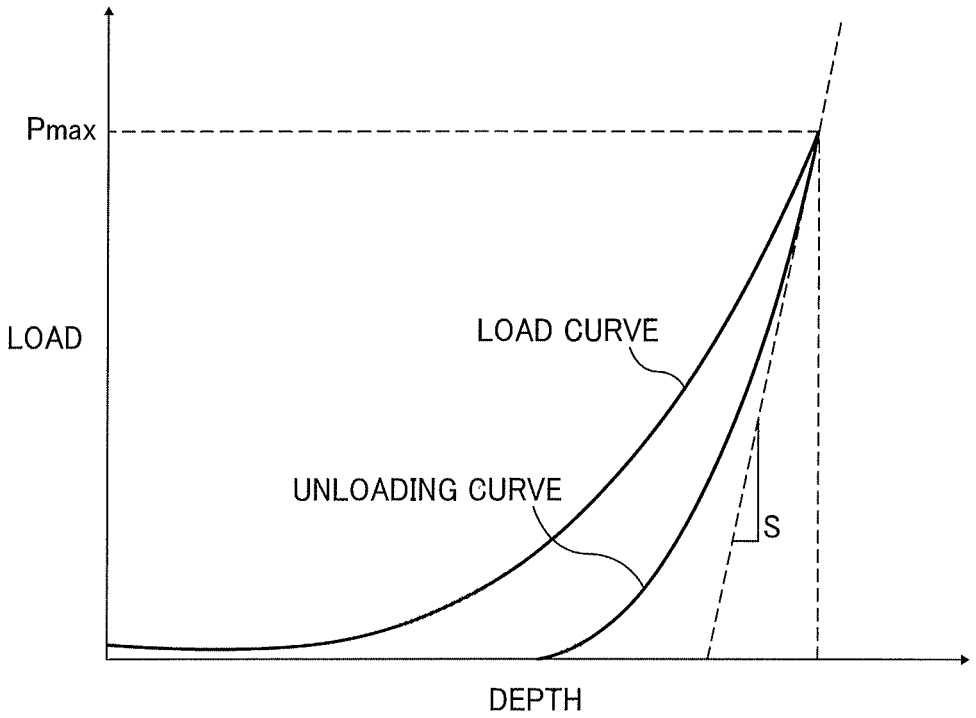
FIG. 7 illustrates a typical load vs. displacement curve.

FIG. 7 illustrates a typical load-displacement curve obtained when the hardness and the elasticity are measured by the nano-indentation method.

Figure 8:
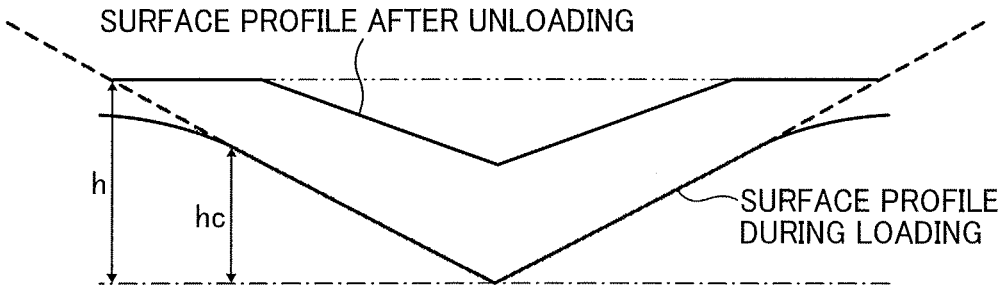
FIG. 8 illustrates an example of a surface profile of a medium.

Referring to FIG. 8, calculation of the harness is described. FIG. 8 illustrates surface profiles of the medium when the indenter is contacted the medium as a sample and a load is applied, and when the indenter is away from the medium and the load is removed.

Herein, the surface hardness H of the medium 10 by the nano-indentation method can be obtained from the following formula 1:

[Formula 1]

$$H = P\max / A \quad (1)$$

In Formula 1, Pmax is the maximum load applied to the indenter, and A is a contact projection area between the indenter and the sample (medium).

The contact projection area A can be represented by the following formula 2 using a depth hc in FIG. 8:

[Formula 2]

$$A = 24.5\ hc^2 \quad (2)$$

The depth hc is shallower due to an elastic indent on the peripheral surface of the contact point than the depth h as a total push-in depth, and is represented by the following formula 3:

[Formula 3]

$$hc=h-hs \quad (3)$$

The depth hs is an amount of indent due to elasticity, and is represented by the following formula 4 from a slant S (i.e., the slant S in FIG. 7) of the load curve after the indenter 132 is pushed and a shape of the indenter:

[Formula 4]

$$hs=\epsilon\times P/S \quad (4)$$

$\epsilon$ is a constant related to a shape of the indenter 132 and 0.75 as to Berkovich indenter.

In addition, the complex elasticity Er can be obtained by the following formula 5:

[Formula 5]

$$Er=S\sqrt{\pi}/(2\times\sqrt{A}) \quad (5)$$

Using the measuring equipment as described above, the hardness and the elasticity can be obtained.

Measurement conditions are as follows:

Measurement equipment: TI 950 TriboIndenter produced by Hysitron

Measurement indenter: Diamond Berkovich indenter 132 having an equilateral-triangular tip shape Measurement environment: 23° C., 60% RH Measurement sample: Medium is cut into square centimeter (=1 cm×1 cm) and is secured on SUS plate with a depth of 2 mm Indentation speed: 20 nm/s Each sample is measured at four points randomly, and an average value is set as the hardness and the elasticity measured by the nano-indentation method.

Various methods have been available as a method for measuring the surface hardness of the substance starting from Vickers hardness test, and each method has a problem of excessively greater load and greater indentation depth.

In particular, it is very difficult to correctly measure the surface hardness of the substance with a soft body such as coated paper by any method other than nano-indentation. Further, piling is considered to be generated due to long-term accumulation of abrasion from several tens to several hundreds of angstroms from the surface of the coat layer. As a result, to understand the mechanism, the topmost surface physical property alone should be correctly measured.

Specifically, the agglomeration and abrasion phenomenon occurring in general due to a contact between a hard substance and a soft substance is thought to be generated because the surface of the soft substance adheres to the surface of the hard substance, and the soft substance is scuffed.

The hard members inside the liquid discharge apparatus include members that cause piling by contacting a print surface or image forming surface of the medium, that is, a contact member such as the feed roller as a representable example. The soft members include a surface of the medium 10 after the pre-treatment liquid 27 is applied and dried.

Even though the roller used in the conveyance path of the medium 10 is subjected to polishing processing, the roller still has asperities of approximately several micrometers. The medium 10 is supported by the convex portion from a micro point of view, and the convex portion functions as a contact point of abrasion when the medium 10 contacts the roller.

Based on the abrasion theory, the lower the surface hardness of the medium 10, the greater the contact binding property between the medium 10 and the contact member becomes. When the shear stress works due to digging the convex portion, the abrasion particles may be generated. In addition, the higher the viscosity on the surface of the medium 10, energy generated by digging of the roller contacting the convex contact point of the medium tends to be used for plastic deformation of the surface of the medium, so that more abrasion particles are taken off from the surface.

Not only the surface hardness and the viscosity of the medium, the surface roughness of the hard member contacting the medium is also an important factor.

The convex portion of the roller as a contact member serves as a contact point of the abrasion when the roller contacts the medium 10. The greater the asperities, the convex portion tends to work to stick in the surface of the surface property improvement process layer, and encourages digging effect, or scuffing, of the surface when the abrasion phenomenon occurs.

The medium 10 is an elastic body, and, from the micro point of view, is conveyed under a certain tension, while constantly vibrating minimally. The contact point moves while being abraded constantly, so that the agglomeration and abrasion phenomenon occurs constantly around the contact point. As a result, the physical property of the topmost surface of the surface property improvement process layer of the medium 10 is the greatest factor of the piling phenomenon.

Then, by controlling the physical property of the surface of the medium 10 within the range of the present disclosure, piling can be prevented.

In addition, when the physical property of the surface of the coat layer during operation is out of the range defined by the present disclosure, it can be determined that such a medium or a driving condition generates piling without actually operating the device for the equivalent of several tens of kilometers or several hundreds of kilometers. Based on the result, using a method to be described later, conditions not to cause piling can be set and implemented.

In general, the coat layer of the offset sheet is varied depending on the type of coated paper. The coat layer with a grading of A2 coat has a thickness of some 10 μm. The thickness of the coat layer for the coated paper in which piling occurs and the coated paper in which piling does not occur is substantially the same.

On the other hand, the piling amount generated when the medium has been conveyed by a distance of 100 kilometers, was 0.1 grams per an area of 25 $cm^2$ of the contact member or the roller. Conversion from the number of contact members or the rollers inside the liquid discharge apparatus and a width of the medium for conveyance amounts to 0.001 μm (=1 nm) abrasion of the surface layer.

Then, measuring depth of the physical property of the coat layer necessary for determining presence and absence of piling has been investigated.

Figure 9:
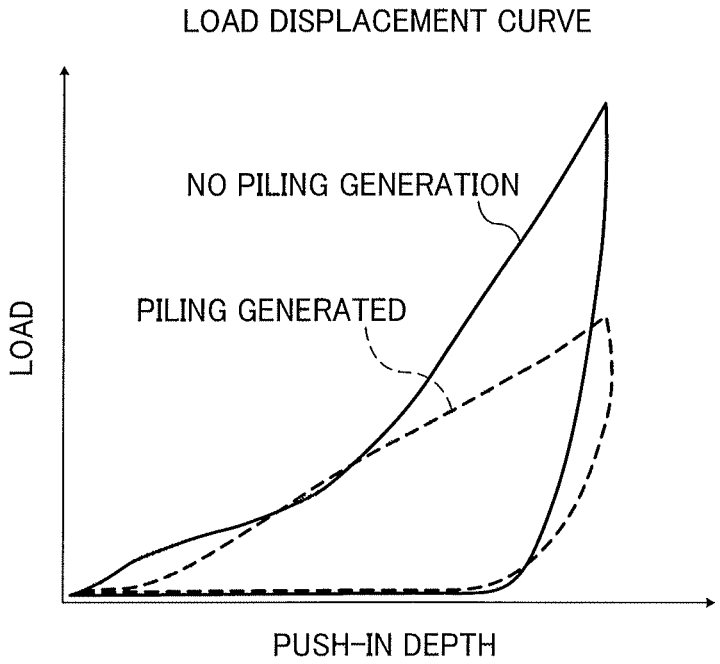
FIG. 9 illustrates an example of a measurement by the nano-indentation method.

FIG. 9 illustrates a result of measuring the hardness of the coated paper in which no piling occurs and the paper in which piling occurs after conveyance of 100 kilometers, at a portion having a depth of 500 nm from the surface of the paper by nano-indentation method.

As a result, it was found that there is a distinct difference as to the load curve and the unloading curve between the coated paper in which no piling occurs and the coated paper in which the piling occurs.

When an excess amount of the pre-treatment liquid is applied to the coat layer of the coated paper and is dried, strength of the coat layer degrades compared to a case of applying a normal coating amount. Further, if drying continues for a longer time, it was confirmed that the strength recovers to a level of the coated paper to which a normal amount of pre-treatment liquid is applied.

Figure 10A:
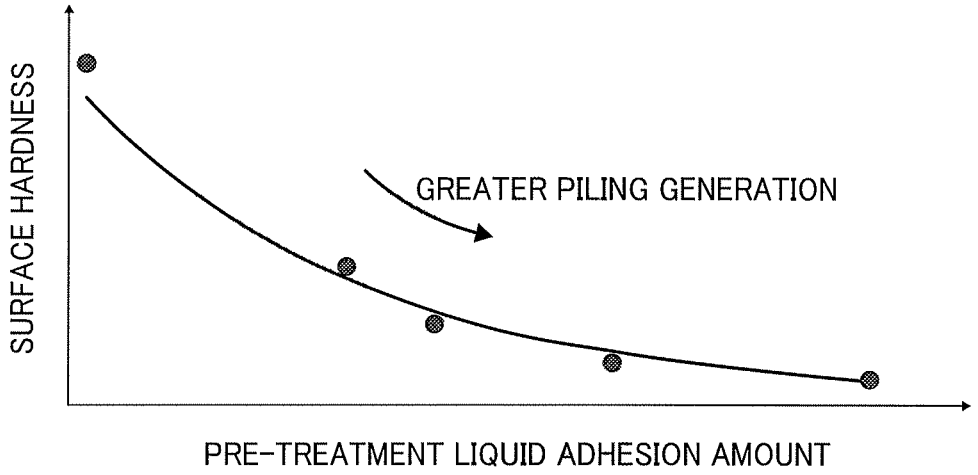
FIG. 10A illustrates a relation between a pre-treatment liquid adhesion amount and the surface harness of the medium.
Figure 10B:
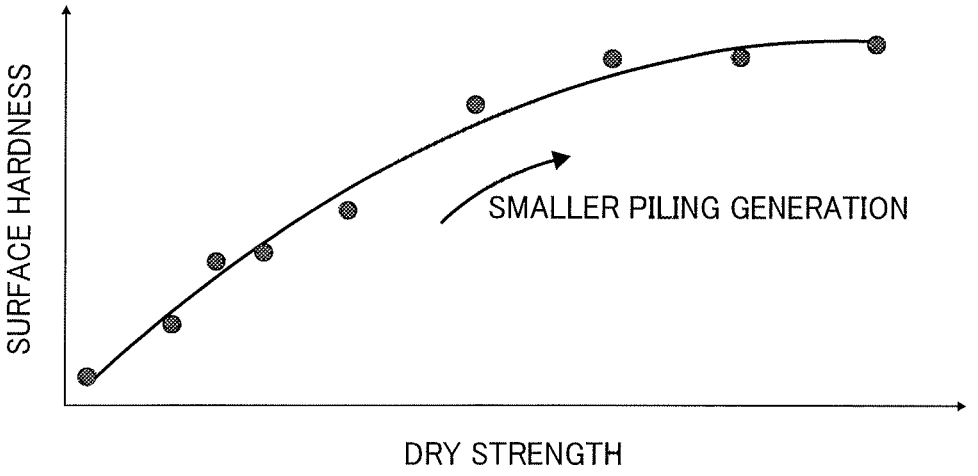
FIG. 10B illustrates a relation between drying strength and the surface harness of the medium.

As illustrated in FIGS. 10A and 10B, it was found that the degradation in the strength of the coat layer of the medium occurs in proportional to the coating and drying of the pre-treatment liquid and depends on the supply amount thereof and the drying strength.

Accordingly, by adjusting the supply amount of the pre-treatment liquid, occurrence of piling can be prevented.

Specifically, when the surface hardness of the medium decreases, the occurrence of piling can be prevented by decreasing the supply amount of the pre-treatment liquid.

In addition, by strengthening drying strength, it is possible to increase the surface hardness of the medium and prevent the piling from occurring. The drying strength is a value defined by the drying temperature and the drying time of period.

The drying strength may be adjusted by increasing the drying temperature and reducing the linear speed of feeding the medium so as to prolong the drying time period of the first drying device 3.

Figure 11:
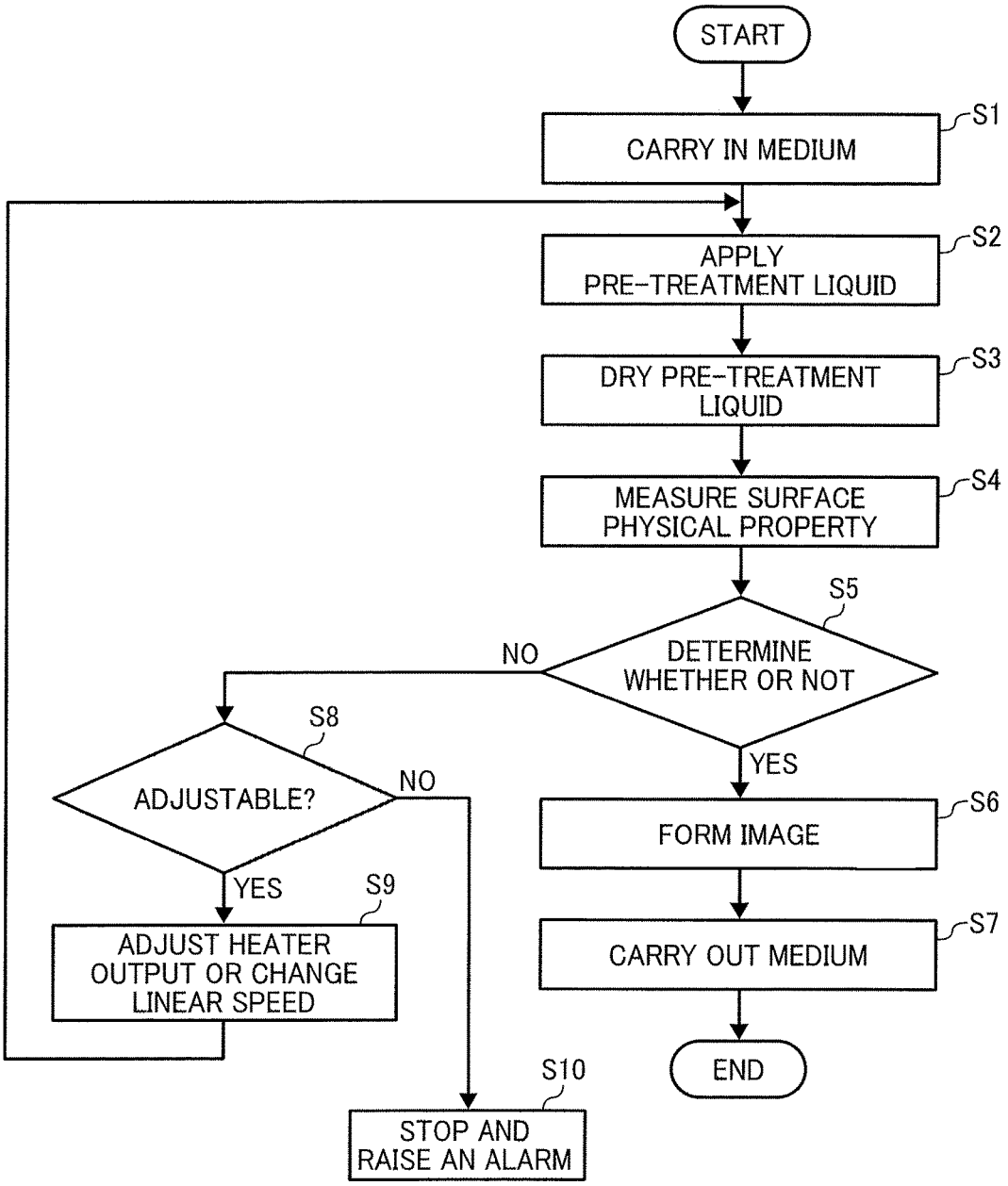
FIG. 11 illustrates a flow of an example of a control process performed by the control device.

Next, referring to the flowchart illustrated in FIG. 11, a control process performed by the controller will be described.

When a control starts, first, the carry-in device 1 carries in the medium 10 (in step S1), the pre-treatment device 2 applies the pre-treatment liquid 27 to the medium 10 (S2), and the first drying device 3 after the pre-treatment liquid application dries the pre-treatment liquid 27 (S3).

Then, the liquid discharge apparatus is once stopped, and before the start of printing or image formation, the physical property of the surface of the medium 10 is measured (S4) and whether the physical property is a predetermined amount or not is determined (S5).

In this case, when the determination is OK, the printing device 5 forms an image (S6), the medium 10 on which the image is formed is carried out to the carry-out device 9 (S7), and a process ends.

On the other hand, if the determination is not OK, whether adjustment can be possible or not is determined (S8).

If adjustable, outputs from the heat rollers 31 and 32 of the first drying device 3 after pre-treatment liquid application are adjusted, or alternatively, the linear speed of the medium 10 is changed (S9), and the process returns to the process in which the pre-treatment liquid 27 is applied (S2).

If not adjustable, operation of the liquid discharge apparatus is stopped, and an alarm is raised (S10).

More specifically, before starting a target print job, a test chart is printed and is read by a scanner. The test chart is subjected to a head shading correction, and is again printed and verified. Then, the target print job is started. In this case, the hardness of the medium 10 (i.e., the coated paper, for example) is checked, and the temperature of the drying device is optimized and the target print job is started. When the hardness of the coat layer does not increase to the defined value or more, even though a parameter such as a drying temperature is set to a limit value, an alarm is raised to inform a risk, and allows an operator to make a final decision.

In the present embodiment, the physical property (such as a physical property of the medium 10 used, and thickness and weight of the paper) is input to the upper device 600, so that permeability of the medium in printing operation is calculated, and an optimal supply amount of the pre-treatment liquid is calculated. Then, the upper device 600 sends the information of the calculated pre-treatment liquid to the main controller 501 of the output control device 500 as control information (or print information data).

The main controller 501 gives information of the pre-treatment liquid supply amount to the pre-treatment liquid applicator controller 521, and the pre-treatment liquid applicator controller 521 converts the pre-treatment liquid supply amount to a nip pressure of the pre-treatment liquid applicator 20, so that the pressure adjuster 25 adjusts to obtain the converted nip pressure.

With this structure, the pre-treatment liquid applicator 20 supplies a designated supply amount of the pre-treatment liquid 27 to the medium 10. As described heretofore, the supply amount is such an amount that the surface hardness of the medium 10 after the pre-treatment liquid 27 applied to the medium 10 has been dried, measured by nano-indentation method becomes 0.07 GPa or more.

With this structure, occurrence of piling can be prevented as much as possible.

In addition, the supply amount of the pre-treatment liquid is stored inside the main controller 501 or in a memory included in the output control device 500 for each of the types of media. When the type of medium 10 is designated, the stored supply amount of the pre-treatment liquid is read out and the pre-treatment liquid applicator 20 can be controlled such that the stored supply amount is applied to the medium.

Further, information related to the permeability for each type of medium is stored inside the main controller 501 or in a memory included in the output control device 500. When the type of medium 10 is designated, the stored information related to the permeability of the medium is read out, and the supply amount of the pre-treatment liquid can be calculated from the value of the permeability.

Furthermore, the supply amount can be adjusted by a rotary speed of the coating roller 23. In this case, the pre-treatment liquid applicator controller 521 is configured to control the rotary speed of the platen roller 24 of the pre-treatment liquid applicator 20. The pre-treatment liquid applicator controller 521 controls the rotary speed of the platen roller 24 based on the information related to the given supply amount of the pre-treatment liquid.

In addition, the supply amount of the pre-treatment liquid can be determined according to other physical property other than the information related to the permeability of the pre-treatment liquid, as far as the information relates to the physical property related to the agglomeration of the liquid on the medium.

In this way, the supply amount of the treatment liquid is controlled to an amount such that the surface hardness of the medium after the treatment liquid has been dried is 0.07 GPa or more taken by nano-indentation method.

As a result, in the method to apply the treatment liquid to the medium according to the present embodiment, a predetermined amount of treatment liquid is applied to the medium such that the surface hardness of the medium after the treatment liquid has been dried, measured by nano-indentation method, is 0.07 GPa or more. In the image forming method according to the present embodiment, the liquid is applied to the medium and an image is formed such that the surface hardness of the medium after the-treatment liquid has been dried, measured by nano-indentation method, is 0.07 GPa or more.

Next, preferred embodiments are described in detail.

Preparation Example 1

Preparation of Pre-Treatment Liquid

Following components were stirred for one hour and uniformly mixed. Water was added such that a total 100 mass % can be obtained relative to the obtained mixture, and the mixture was stirred for one hour. Next, the mixture was pressurized and filtered using a cellulose acetate membrane filter with an average pore diameter of 0.8 μm, coarse particles were removed, and pre-treatment liquid A1 was prepared.

Components of Pre-Treatment Liquid 1,3-butanediol . . . 10 mass %

L-lactic acid . . . 15 mass %

Fluoric surfactant (PolyFox PF-151N, produced by Daikin Industries, Ltd.) . . . 0.05 mass %

Antifoaming agent (Silicon KM-72F, produced by Shin-etsu Chemical Co., Ltd.) . . . 0.05 mass %

2-amino-2-ethyl-1,3-propanediol . . . 0.1 mass %

N—N-diethylethanolamine . . . 23.42 mass %

Lactic acid calcium . . . 5 mass %

Surfactant (RF-O-polyoxyethylene ether, produced by Neos Corporation, Trade name: Futargent 251) . . . 0.1 mass %

Polyether modified silicon compound (KF-643, produced by Shin-etsu Chemical Co., Ltd.) . . . 1 mass %

Mildewcide (1,2-benzisothiazoline-3-ON-dipropyrene glycol 20% aqueous solution; produced by Arch Chemicals Japan, Trade name: Proxel GXL) . . . 0.05 mass %

1,2,3-benzotriazol . . . 0.1 mass %

Ion-exchange water . . . remaining amount

Preparation Example 2

Preparation of Cyan Pigment Dispersion

After an inside of one liter flask including a mechanical stirrer, thermometer, nitrogen gas introduction tube, reflex tube, and dropping funnel is sufficiently substituted with nitrogen gas, 11.2 grams of styrene, 2.8 grams of acrylic acid, 12.0 grams of lauryl methacrylate, 4.0 grams of polyethylene glycol methacrylate, 4.0 grams of styrene macromere (produced by TOAGOSEI CO., Ltd., Trade name: AS-6), and 0.4 grams of mercaptoethanol were tucked inside the flask and heated up to a temperature of 65° C.

Next, a mixed solution including 100.8 grams of styrene, 25.2 grams of acrylic acid, 108.0 grams of lauryl methacrylate, 36.0 grams of polyethylene glycol methacrylate, 60.0 grams of hydroxyl ethyl methacrylate, 36.0 grams of styrene macromere (produced by TOAGOSEI CO., Ltd. Trade name: AS-6), 3.6 grams of mercapto ethanol, 2.4 grams of azobisdimethylvaleronitrile, and 18 grams of methylethylketone were dropped into the flask during a time period of 2.5 hours.

After dropping the mixed solution, a mixed solution including 0.8 grams of azobisdimethylvaleronitril and 18 grams of methylethylketone were dropped into the flask during a period of 0.5 hours.

After the mixed solution was aged during one hour at 65° C., 0.8 grams of azobisdimethylvaleronitril was added and the mixed solution was aged for further one hour. After the reaction, 364 grams of methylethylketone was added, to thereby obtain 800 grams of polymer solution with a density of 50 mass %.

A part of the obtained polymer solution was dried, and was measured by a gel-permeation chromatography (standard: polystyrene, solvent: tetrahydrofuran), and the obtained mass average molecular weight was 15,000.

Next, 28 grams of the obtained polymer solution, 26 grams of chalco-phthalocyanine pigment, 13.6 grams of 1 mol/L aqueous solution of potassium hydrate, 20 grams of methylethylketone, and 30 grams of ion-exchange water were sufficiently stirred.

Thereafter, three roll mills (produced by NORITAKE CO., LTD., Trade name: NR-8) were used and kneaded 20 times, to thereby obtain a paste. The obtained paste was inserted into 200 grams of ion-exchange water and stirred sufficiently. Then, methylethylketone and water were removed using an evaporator, to thereby obtain 160 grams of cyan pigment-containing polymer particle dispersion having 20.0 mass % of solid content.

Volume average particle size of the obtained cyan pigment-containing polymer particles was measured by Microtrac UPA (produced by MicrotracBEL Corp.) and the volume average particle size was found to be 98 nm.

Preparation Example 3

Preparation of Magenta Pigment Dispersion

Except that Chalco-phthalocyanine pigment of the cyan dispersion was changed to a pigment red 122, a magenta pigment-containing polymer particle dispersion was obtained similarly to the preparation of the cyan dispersion.

The volume average particle size of the obtained magenta pigment-containing polymer particles was measured by Microtrac UPA (Produced by MicrotracBel Corp.) and the volume average particle size was found to be 124 nm.

Preparation Example 4

Preparation of Yellow Pigment Dispersion

Except that Chalco-phthalocyanine pigment of the cyan dispersion was changed to a pigment yellow 74, a yellow pigment-containing polymer particle dispersion was obtained similarly to the preparation of the cyan dispersion.

The volume average particle size of the obtained yellow pigment-containing polymer particles was measured by Microtrac UPA (Produced by MicrotracBel Corp.) and the volume average particle size was found to be 78 nm.

Preparation Example 5

Preparation of Black Pigment Dispersion

Except that Chalco-phthalocyanine pigment of the cyan dispersion was changed to Carbon black (produced by Degussa AG, Trade name: FW100), a black pigment-containing polymer particle dispersion was obtained similarly to the preparation of the cyan dispersion.

The volume average particle size of the obtained black pigment-containing polymer particles was measured by Microtrac UPA (Produced by MicrotracBel Corp.) and the volume average particle size was found to be 110 nm.

Production Examples 1 to 4

Production of Ink 1,3-butanediol, glycerin, anionic fluorine-containing surfactant (produced by OMNOVA Solutions Inc., Trade name:

PolyFox PF-151N), octanediol, and other components were mixed, stirred for one hour, and uniformly mixed.

Into this mixed solution, the cyan, magenta, yellow, and black pigment dispersions were added, respectively, a remaining amount of water was added to be a total 100 mass %, and the resultant solution was stirred for one hour.

Thereafter, the resultant solution was pressurized and filtered using a cellulose acetate membrane filter with an average pore diameter of 0.8 μm, coarse particles were removed, and the ink 1 to 4 were prepared.

TABLE 1-1

| Component (Mass %) | | Production example 1 | Production example 2 |
|---|---|---|---|
| | Ink No. | 1 | 2 |
| Pigment dispersion liquid | Cyan pigment-containing polymer particle dispersion liquid (Preparation example 2) | 40.0 | |
| | Magenta pigment-containing polymer particle dispersion liquid (Preparation example 3) | | 40.0 |
| | Yellow pigment-containing polymer particle dispersion liquid (Preparation example 4) | | |
| | Black pigment-containing polymer particle dispersion liquid (Preparation example 5) | | |
| Water-soluble organic solvent | 1,3-butane diol | 15.0 | 15.0 |
| | glycerin | 15.0 | 15.0 |
| | Octane diol | 2.0 | 2.0 |
| Surfactant | PolyFox PF-151N | 1.0 | 1.0 |
| Mildewcide | Proxel GXL | 0.05 | 0.05 |
| Antifoam agent | Silicon antifoam agent KM-72F | 0.10 | 0.10 |
| pH adjuster | 2-amino-2-ethyl-1,3-propanediol | 0.3 | 0.3 |
| | Pure water | Remaining amount | Remaining amount |
| | Total (Mass %) | 100 | 100 |

TABLE 1-2

| Component (Mass %) | | Production example 3 | Production example 4 |
|---|---|---|---|
| | Ink No. | 3 | 4 |
| Pigment dispersion liquid | Cyan pigment-containing polymer particle dispersion liquid (Preparation example 2) | | |
| | Magenta pigment-containing polymer particle dispersion liquid (Preparation example 3) | | |
| | Yellow pigment-containing polymer particle dispersion liquid (Preparation example 4) | 40.0 | |
| | Black pigment-containing polymer particle dispersion liquid (Preparation example 5) | | 40.0 |
| Water-soluble organic solvent | 1,3-butane diol | 15.0 | 15.0 |
| | glycerin | 15.0 | 15.0 |
| | Octane diol | 2.0 | 2.0 |
| Surfactant | PolyFox PF-151N | 1.0 | 1.0 |
| Mildewcide | Proxel GXL | 0.05 | 0.05 |
| Antifoam agent | Silicon antifoam agent KM-72F | 0.10 | 0.10 |
| pH adjuster | 2-amino-2-ethyl-1,3-propanediol | 0.3 | 0.3 |
| | Pure water | Remaining amount | Remaining amount |
| | Total (Mass %) | 100 | 100 |

Embodiments 1 to 5

Image Forming Process

As shown in Table 2-1 and Table 2-2 (hereinafter, collectively referred to as Table 2), the pre-treatment liquid A1 was applied to a roll paper by roller coating method varying a supply amount of the pre-treatment liquid, and 100 kilometers printing test was performed. The drying condition in this case was as shown in Table 2.

In the printing test, the inks as shown in Table 1-1 and Table 1-2 were used.

Piled substances on the roller after 100 kilometers printing test were measured. The obtained results were shown in Table 2.

TABLE 2-1

| | Medium | | | Supply | | Test feed |
|---|---|---|---|---|---|---|
| | | Weight (gsm) | Pre-treatment | amount ($g/m^2$) | Drying | distance (km) |
| Embodiment 1 | Sheet A | 90 | Pre-treatment liquid | 1.28 | Standard | 100 |
| Embodiment 2 | Sheet A | 90 | Pre-treatment liquid | 1.76 | Strong | 100 |
| Embodiment 3 | Sheet B | 118 | Pre-treatment liquid | 0.64 | Strong | 100 |
| Embodiment 4 | Sheet B | 118 | Pre-treatment liquid | 1.28 | Standard | 100 |
| Embodiment 5 | Sheet B | 118 | Pre-treatment liquid | 1.28 | Standard | 100 |

TABLE 2-2

| | Piling weight ($g/25\ cm^2$) | Roller Ra (μm) | Piling amount inside device (g) | Surface physical property | | |
|---|---|---|---|---|---|---|
| | | | | Hardness (GPa) | Elasticity | Depth (nm) |
| Embodiment 1 | 0 | 1.5 | 0 | 0.12 | 5.05 | 500 |
| Embodiment 2 | 0 | 1.5 | 0 | 0.11 | 5.06 | 500 |
| Embodiment 3 | 0 | 1.5 | 0 | 0.07 | 4.20 | 500 |
| Embodiment 4 | 0.08 | 1.5 | 417.9968 | 0.05 | 3.35 | 500 |
| Embodiment 5 | 0.15 | 3.0 | 783.7 | 0.05 | 3.35 | 500 |

In Table 2, "Pre-treatment" means that the pre-treatment liquid was coated, and "Supply amount" means a supply amount of the pre-treatment liquid. "Drying" means a degree of drying of the pre-treatment liquid. "Standard" degree of drying is 3 seconds at 80° C., and "Strong" degree of drying is 5 seconds at 100° C. "Test feed distance" shows the distance for feeding the medium to verify occurrence of the piling phenomenon. "Piling amount" is the weight of the foreign substances piled on the contact member per an area of 25 $cm^2$. "Roller Ra" shows Ra of the surface of the roller to which the medium surface that has been applied the pre-treatment liquid after drying the pre-treatment liquid, contacts. "Piling weight inside the device" was calculated from the piling weight of the foreign substances piled on all the contact members.

Figure 12:
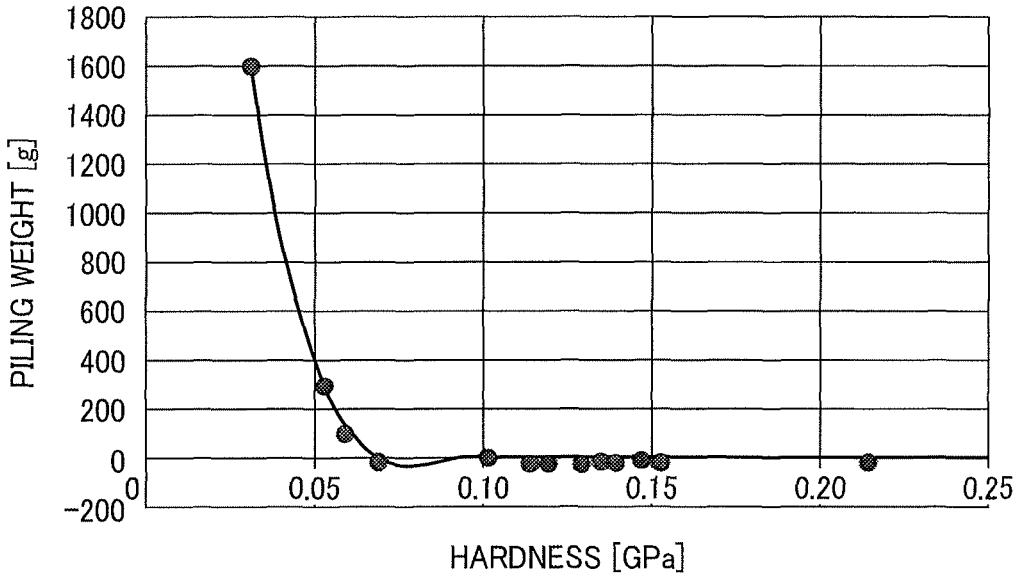
FIG. 12 illustrates a relation between hardness and piling weight.

FIG. 12 illustrates a relation between the piling amount and the hardness. The supply amount of the treatment liquid is controlled to an amount such that the surface hardness of the medium after the pre-treatment liquid has been dried, taken by nano indentation method, is 0.07 GPa or more, thereby suppressing an occurrence of piling.

Figure 13:
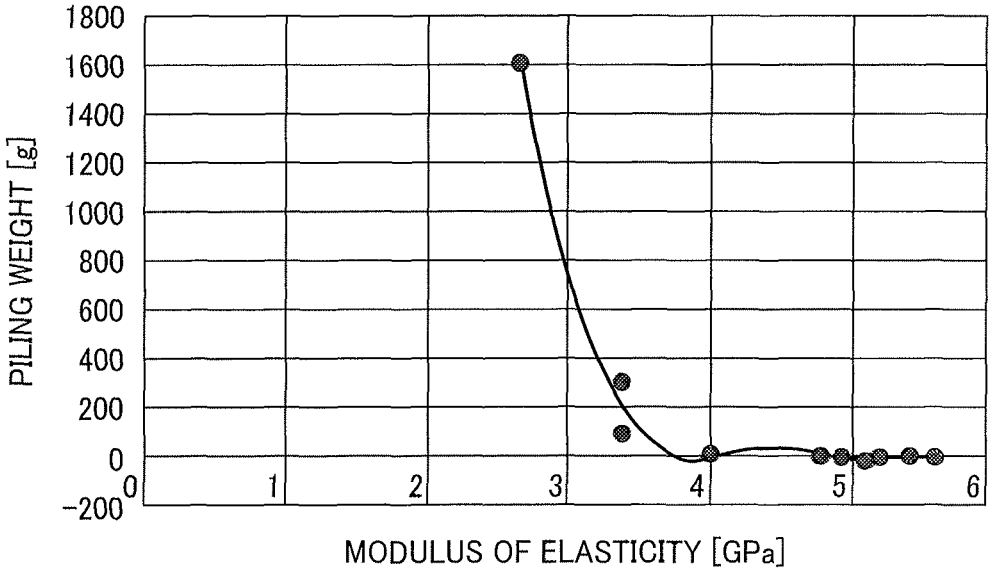
FIG. 13 illustrates a relation between elasticity and piling weight.

From FIG. 13 illustrating a relation between the piling amount and the elasticity, it can be seen that the occurrence of piling can be suppressed when the elasticity of the medium after the treatment liquid has been dried, taken by the nano-indentation method, is 4 GPa or more. In addition, it is preferred that the surface hardness and the elasticity be measured at a depth of 500 nm from the topmost surface of the medium in a state in which the pre-treatment liquid is applied.

In addition, from the results of embodiment 3 and others, the surface roughness Ra of the contact member (i.e., the roller) that contacts the surface of the medium on which the pre-treatment liquid 27 is applied is preferably 2 μm or less, for the purpose of suppressing occurrence of piling.

Additional modifications and variations of the present disclosure are possible in light of the above teachings. It is therefore to be understood that, within the scope of the appended claims, the disclosure may be practiced other than as specifically described herein.

What is claimed is:

1. A liquid discharge apparatus comprising:

a pre-treatment device to apply a treatment liquid to a medium, the pre-treatment device including:

a treatment liquid storing part to store the treatment liquid to be applied; and a plurality of rollers including a pick-up roller to pick-up the treatment liquid from the treatment liquid storing part, and an applying roller to receive the picked-up treatment liquid transferred by the pick-up roller and to apply the transferred treatment liquid to the medium;

a drying device to dry the treatment liquid applied to the medium;

a device to apply a liquid containing a colorant to the medium on which the treatment liquid has been applied; and a control device to control the rollers to apply a supply amount of the transferred treatment liquid to a surface of the medium such that, after the drying device dries the surface of the medium, the surface of the medium has a surface hardness of 0.07 GPa or more as measured by nano indentation.

2. The liquid discharge apparatus according to claim 1, wherein elasticity of the medium is 4 GPa or more as measured by nano indentation after the treatment liquid is dried.

3. The liquid discharge apparatus according to claim 2, wherein the surface hardness and the elasticity of the medium are measured at a depth of 500 nm from a topmost surface of the medium in a state in which the treatment liquid has been applied.

4. The liquid discharge apparatus according to claim 1, wherein the medium includes a surface property improvement process layer including at least a water-soluble resin on a side on which the treatment liquid is applied.

5. The liquid discharge apparatus according to claim 1, wherein the treatment liquid includes at least one of water and a water-soluble solvent.

6. The liquid discharge apparatus according to claim 1, further comprising a contact member to contact a surface of the medium on which the treatment liquid has been applied, wherein the contact member has a surface roughness Ra of 2 μm or less.

7. The liquid discharge apparatus according to claim 1, wherein a drying strength of the drying device to dry the treatment liquid is adjusted according to the surface hardness of the medium.

8. A method of applying a treatment liquid to a medium to which a liquid including a colorant is applied, the method comprising:

(a) providing a pre-treatment device to apply the treatment liquid to the medium, the pre-treatment device including:

a treatment liquid storing part to store the treatment liquid to be applied; and a plurality of rollers including a pick-up roller to pick-up the treatment liquid from the treatment liquid storing part, and an applying roller to receive the picked-up treatment liquid transferred by the pick-up roller and to apply the transferred treatment liquid to the medium; and (b) before the liquid including the colorant is applied, applying, controlling the rollers of the pre-treatment device to apply the treatment liquid in an amount such that, after the treatment liquid has been dried, a surface hardness of the medium is 0.07 GPa or more as measured by nano indentation.

9. A method of forming an image, comprising:

(a) controlling a pre-treatment device to apply a treatment liquid to a medium, the pre-treatment device including:

a treatment liquid storing part to store the treatment liquid to be applied; and a plurality of rollers including a pick-up roller to pick-up the treatment liquid from the treatment liquid storing part, and an applying roller to receive the picked-up treatment liquid transferred by the pick-up roller and to apply the transferred treatment liquid to the medium;

(b) drying, by a drying device, the treatment liquid applied to the medium; and (c) applying a liquid including a colorant to the medium to thereby form an image, the rollers having been controlled in (a) to apply a supply amount of the transferred treatment liquid to a surface of the medium such that the surface of the medium, after the treatment liquid is dried in (b), and to which the liquid including the colorant has been applied in (c) has a surface hardness of 0.07 GPa or more as measured by nano indentation.

10. The method according to claim 9, further comprising:

contacting the surface of the medium on which the treatment liquid has been applied in (a), with a contact member having a surface roughness Ra of 2 μm or less.

11. The method according to claim 8, further comprising:

(c) contacting a surface of the medium on which treatment liquid has been applied in (b), with a contact member having a surface roughness Ra of 2 μm or less.

12. The liquid discharge apparatus according to claim 1, wherein the plurality of rollers further comprises a platen roller that rotates the medium and faces the applying roller and contacts the applying roller via the medium, and the control device maintains a pressure between the platen roller and the applying roller.

* * * * *